US007466215B2

(12) United States Patent
Chou

(10) Patent No.: US 7,466,215 B2
(45) Date of Patent: Dec. 16, 2008

(54) BALANCED MEMS SWITCH FOR NEXT GENERATION COMMUNICATION SYSTEMS

(75) Inventor: Chia-Shing Chou, Oak Park, CA (US)

(73) Assignee: Wireless MEMS, Inc., Oak Park, CA (US)

( * ) Notice: Subject to any disclaimer, the term of this patent is extended or adjusted under 35 U.S.C. 154(b) by 102 days.

(21) Appl. No.: 11/499,439

(22) Filed: Aug. 4, 2006

(65) Prior Publication Data

US 2007/0030104 A1 Feb. 8, 2007

Related U.S. Application Data

(60) Provisional application No. 60/705,879, filed on Aug. 4, 2005.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 6,440,767 B1 * 8/2002 Loo et al. ..... 438/52
6,624,720 B1 * 9/2003 Allison et al. ..... 333/105
6,962,832 B2 * 11/2005 Chou ..... 438/52
7,283,023 B2 * 10/2007 Robert ..... 335/78

* cited by examiner

*Primary Examiner*—Elvin Enad
*Assistant Examiner*—Bernard Rojas
(74) *Attorney, Agent, or Firm*—Tope-Mckay & Associates

(57) ABSTRACT

A micro-electro-mechanical system (MEMS) switch is described. The MEMS switch includes both RF-input and output transmission lines formed on a substrate. An RF armature is anchored to the substrate and is electrically connected with the RF-output transmission line. A contact is electrically connected with the RF-input transmission line. Both bias-input and output signal lines are formed on the substrate. A bias armature is anchored to the substrate and is electrically connected with the bias-input signal line. A DC/RF isolation insulator connects the bias armature with the RF armature. When a charge is introduced to the bias-input signal line, the bias armature is forced toward the bias-output signal line, thereby forcing the RF armature to connect with the contact and form an electrical circuit between the RF-input transmission line and the RF-output transmission line.

24 Claims, 1 Drawing Sheet

FIG. 1

BALANCED MEMS SWITCH FOR NEXT GENERATION COMMUNICATION SYSTEMS

PRIORITY CLAIM

The present application is a non-provisional utility patent application, claiming the benefit of priority of U.S. Provisional Patent Application No. 60/705,879, filed Aug. 4, 2005, titled "A BALANCED MEMS SWITCH FOR NEXT GENERATION COMMUNICATION SYSTEMS."

BACKGROUND OF THE INVENTION (1) Field of Invention

The present invention relates to a micro-electro-mechanical system (MEMS) switch, and more particularly to a balanced MEMS switch having a bias armature and an RF armature, each having their own anchors and being positioned substantially perpendicular to each other.

(2) Description of Related Art

Micro-electro-mechanical system (MEMS) switches have long been known in the art. MEMS have been formed in a myriad of designs, including an armature design. The armature design often includes an armature affixed to two anchors at both ends of the armature, with the ends separated by 180 degrees. Such an armature design tends to have an improved contact mechanism and a flatter beam. However, the stress relief mechanism of such an armature may be inferior due to its rigidness. As a result, it may be more sensitive to an environmental temperature change and has a higher actuation voltage than other designs, unless some a design technique such as a meander is adopted. The meander technique is described in an article entitled, "MEM Relay for Reconfigurable RF Circuits," R. E. Mihailovich, *Member, IEEE*, M. Kim, *Member, IEEE*, J. B. Hacker, *Member, IEEE*, E. A. Sovero, *Member, IEEE*, J. Studer, J. A. Higgins, *Fellow, IEEE*, and J. F. DeNatale, in IEEE MICROWAVE AND WIRELESS COMPONENTS LETTERS, Vol. 11, No. 2, February 2001. The article is incorporated herein by reference as though fully set forth herein.

U.S. Pat. No. 6,046,659, issued to Loo et al. (herein after referred to as the patent '659), discloses a MEMS switch utilizing another armature design. In the patent '659, only one end of an armature is affixed to an anchor electrode and the other end of the armature rests above a contact electrode. Due to one single anchor design and its resulting lower rigidity, it can alleviate the problems caused by the stress. However, it has two contact areas which will result in a higher contact resistance than a switch having only one contact area. In addition, the two contact areas may not reach the optimal contact condition simultaneously which can cause further contact problems.

Thus, a continuing need exists for an improved MEMS switch having a configuration that provides an improved stress relief mechanism, reduced contact resistance, a uniform actuation voltage, and that is less sensitive to a change of environmental temperature.

SUMMARY OF INVENTION

The present invention relates to a micro-electro-mechanical system (MEMS) switch. The MEMS switch comprises an RF-input transmission line formed on a substrate. An RF-output transmission line is also formed on the substrate. An RF armature is connected by an RF anchor to the substrate. The RF armature is electrically connected with the RF-output transmission line. A contact is electrically connected with the RF-input transmission line and formed such that it is proximate the RF armature. The contact and the RF armature are formed such that when the MEMS switch is in an open position, a gap exists between the RF armature and the contact. A bias-input signal line is also formed on the substrate. Additionally, a bias-output signal line is formed on the substrate. A bias armature is connected by a bias anchor to the substrate. The bias armature is electrically connected with the bias-input signal line and being formed such that when the MEMS switch is in an open position, a gap exists between the bias armature and the bias-output signal line. Furthermore, a DC/RF isolation insulator connects the bias armature with the RF armature. When a charge is introduced to the bias-input signal line, the bias armature is forced toward the bias-output signal line, thereby forcing the RF armature to connect with the contact and form an electrical circuit between the RF-input transmission line and the RF-output transmission line.

In another aspect, the present invention further comprises an insulator layer formed on the bias armature such that it is positioned between the bias armature and the bias-output signal line, such that when the bias armature is forced toward the bias-output signal line, the insulator layer prevents an electrical connection therebetween.

In yet another aspect, the present invention further comprises a length with an axis running along its length. Additionally, the RF armature has a length with an axis running along its length. The bias armature is formed such that the axis of the bias armature makes an arbitrary angle to the axis of the RF armature.

In yet another aspect, the bias armature is formed such that it is substantially parallel to the RF armature. The armatures can be closer together in this configuration. Thus, the mechanism for lifting the switch when the switch is in a closed position tends to be more robust and faster.

In yet another aspect, the bias armature is formed such that it is substantially parallel to the RF armature, and the DC/RF isolation insulator is formed such that it is substantially perpendicular to both the bias armature and the RF armature. Again, the armatures can be closer together in this configuration, and the mechanism for lifting the switch when the switch is in a closed position tends to be more robust and faster; in particular, with the DC/RF isolation insulator perpendicular to the bias armature and RF armature, the arrangement occupies the smallest area of the substrate if the sizes of the RF armature and bias armature are fixed.

In yet another aspect, the bias armature is formed such that it is substantially perpendicular to the RF armature. This configuration greatly reduces the probability of the switch sticking in the closed position; effectively, the contact tends to lift from one corner, rather than trying to lift the whole contact at once, which greatly reduces the required mechanical force.

In yet another aspect, the MEMS switch further comprises a second RF-output transmission line formed on the substrate. A second RF armature is connected by a second RF anchor with the substrate. The second RF armature is electrically connected with the second RF-output transmission line. A second contact is electrically connected with the second RF-input transmission line and formed such that it is proximate the second RF armature. The second contact and the second RF armature are formed such that when the MEMS switch is in an open position, a gap exists between the second RF armature and the second contact. A second bias-input signal line is formed on the substrate. Additionally, a second bias-output signal line formed on the substrate. Furthermore, a second bias armature is connected by a second bias anchor to the substrate. The second bias armature is electrically connected with the second bias-input signal line and is formed such that when the MEMS switch is in an open position, a gap exists between the second bias armature and the second bias-output signal line. A second DC/RF isolation insulator connects the second bias armature with the second RF armature. When an electrical charge is introduced to the second bias-input signal line, the second bias armature is forced toward the second bias-output signal line, thereby forcing the second RF armature to connect with the second contact and form an electrical circuit between the RF-input transmission line and the second RF-output transmission line.

In yet another aspect the bias armature has a long axis and the second bias armature has a long axis. Furthermore, the bias armature and the second bias armature are substantially parallel.

In yet another aspect, the signal lines are electrically connected in a combination selected from a group consisting of the bias-input signal line being electrically connected with the second bias-input signal line and the bias-output signal line being electrically connected with the second bias-output signal line, thereby allowing independent control of the RF-output signal line and the second RF-output signal line.

In yet another aspect, the bias-input signal line is electrically connected with the second bias-input signal line, and wherein the bias-output signal line is electrically connected with the second bias-output signal line, thereby forcing the RF-output signal line and the second RF-output signal line to produce substantially identical, substantially simultaneous signals.

In yet another aspect, the bias armature has a long axis, the RF armature has a long axis, and the bias armature is formed such that the long axis of the bias armature makes an arbitrary angle to the long axis of the RF armature.

In yet another aspect, the present invention comprises an array of MEMS switches, each switch is as set forth above, wherein each switch is formed on the substrate and is electrically connected with at least one other switch to form the array.

Finally, as can be appreciated by one in the art, the present invention also comprises a method for forming and using the MEMS switch described herein. The method for forming the MEMS switch comprises a plurality of acts of forming and connecting the various parts and portions of the MEMS switch of the present invention.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
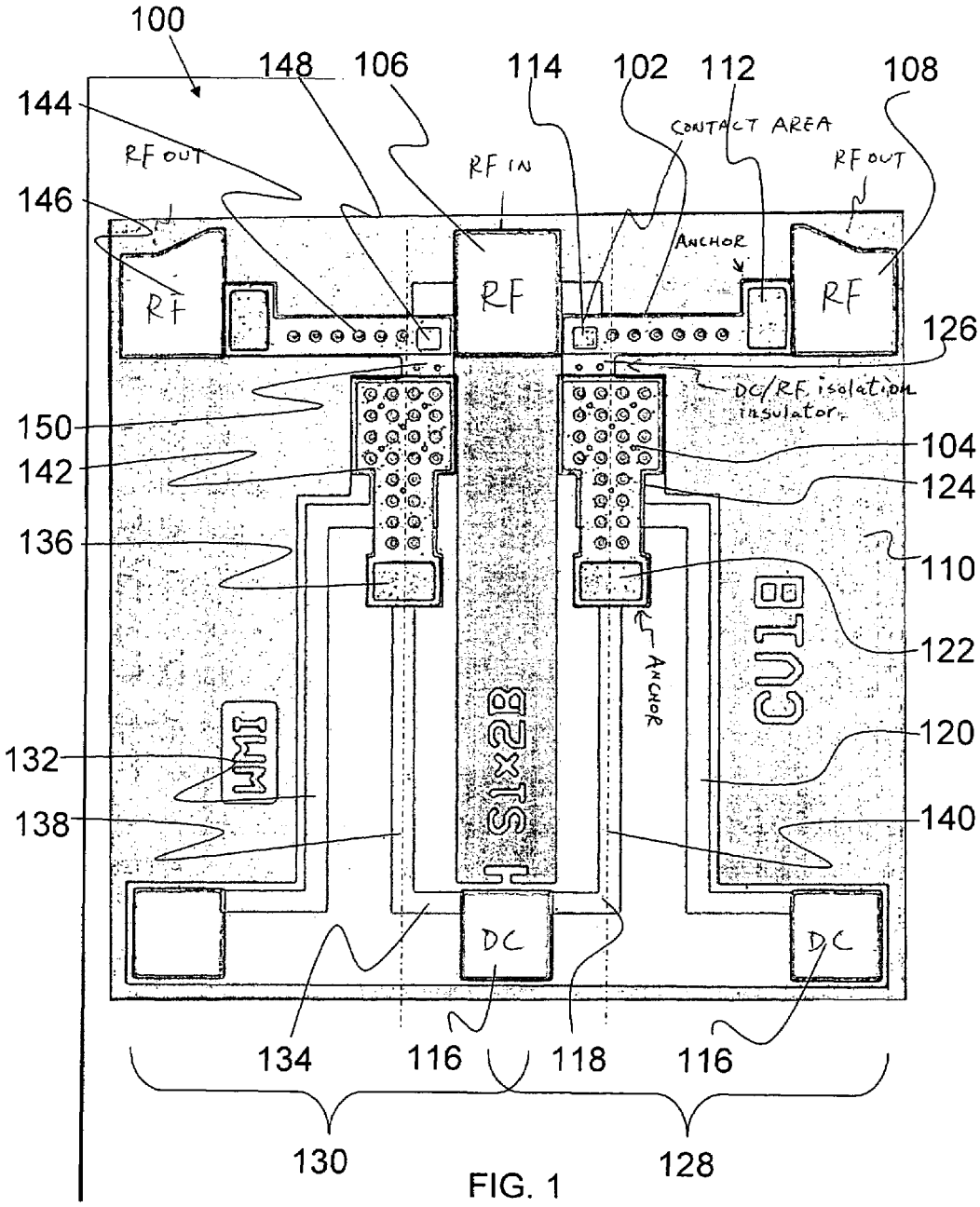
FIG. 1 is a top-view illustration of a micro-electro-mechanical system (MEMS) switch according to the present invention.

The present invention relates to a micro-electro-mechanical system (MEMS) switch, and more particularly to a balanced MEMS switch having a bias armature and an RF armature, each having their own anchors and being positioned substantially perpendicular to each other. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

The present invention relates to a micro-electro-mechanical system (MEMS) switch. The MEMS switch was fabricated using the method described in U.S. Pat. No. 6,962,832 (hereinafter referred to as patent '832), entitled, "A Fabrication Method for Making a Planar Cantilever, Low Surface Leakage, Reproducible and Reliable Metal Dimple Contact Micro-Relay MEMS Switch." patent '832 is incorporated herein by reference as though fully set forth herein. As shown in FIG. 1, the MEMS switch 100 includes two armatures (a radio frequency (RF) armature 102 and a bias armature 104 (e.g., direct current (DC) armature)) substantially perpendicular to each other. An RF-input transmission line 106 is electrically separated from an RF-output transmission line 108 through the RF armature 102 (the two collectively forming an RF transmission line). The RF armature 102 is connected with a substrate 110 through an RF anchor 112. A contact 114 is electrically connected with the RF-input transmission line 106. When the switch 100 is in an open position, a gap exists between the contact 114 and the RF armature 102, thereby preventing an electrical connection between the RF-input transmission line 106 and the RF-output transmission line 108. When the switch is activated and is in a closed position, the RF armature 102 is forced to connect with the contact 114 (forced by movement of the bias armature 104 as discussed below), thereby closing a circuit and providing for an electrical connection between the RF-input 106 and RF-output 108 transmission lines. One skilled in the art will appreciate that the RF-input 106 and RF-output 108 transmission lines are labeled as such for convenience purposes only and are interchangeable.

The bias armature 104 electrically separates at least two bias signal pads 116. A bias-input signal line 118 connects one bias signal pad 116 with the bias armature 104, while a bias-output signal line 120 is connected with another bias signal pad 116 (the bias-input 118 and bias-output 120 signal lines collectively forming a bias signal line. The bias armature 104 is connected with the substrate 110 through a bias anchor 122. One skilled in the art will appreciate that the bias-input 118 and bias-output 120 signal lines are labeled as such for convenience purposes only and are interchangeable.

An insulator layer 124 is attached with the bias armature 104 such that when the switch 100 is in an open position, a gap is present between the insulator layer 124 and the bias-output signal line 120. As a charge is introduced to the bias-input signal line 118, the bias armature 104 is forced toward the bias-output line 120, thus forcing the insulator layer 124 toward the bias-output signal line 120. Although the bias armature 104 is forced toward the bias-output line 120, the insulator layer 124 prevents electrical connection therebetween.

Additionally, although they can be electrically connected, it is desirable that a DC/RF insulation isolator 126 connects the bias armature 104 with the RF armature 102. Accordingly, as a charge is introduced to the bias-input signal line 118, the bias armature 104 is forced toward the bias-output line 120, thereby forcing the RF armature 102 to form an electrical connection with the contact 114 and completing a circuit between the RF-input transmission line 106 and the RF-output transmission line 108.

One of ordinary skill in the art can appreciate that the bias armature 104 can be positioned in all directions in relation to the RF armature 102. Although FIG. 1 illustrates the bias armature 104 being substantially perpendicular (i.e., 90 degrees) to the RF armature 102, the relative positioning can be in all directions, non-limiting examples of which include being from 0 degrees to 180 degrees.

Additionally, it is worth noting that a common ground layer can be connected with the substrate 110 to be used by both the bias signal line 118 and the RF transmission line 106. Although each can use a separate ground, a common ground layer simplifies the fabrication process.

The switch 100 described herein provides a better stress relief mechanism and a single contact area, both of which can result in reduced contact resistance. As a result, this is a balanced design which can yield more uniform actuation voltage, less sensitivity to the change of environmental temperature and optimized contact resistance.

As can be appreciated by one of ordinary skill in the art, the invention described above can be duplicated an arbitrary number of times to make an array of similar devices, with the devices working in parallel. As can further be appreciated by one of ordinary skill in the art, the number of devices that make up the array is completely arbitrary, as is the relative orientations of the devices that make up the array. FIG. 1 illustrates how one might make two such devices (i.e., first device 128 and second device 130) on the same substrate, in a substantially parallel configuration. As shown in FIG. 1, the two devices are mirror images of one another. The second device 130 consists of a second bias armature 142 connected by a second bias anchor 136 to the substrate 110. The second bias armature 142 is electrically connected with a second bias-input signal line 134, which may or may not be the same bias-input signal line 118 belonging to the first device 128. Like the first device 128, when the second device 130 is in an open position, a gap exists between the second bias armature 142 and the second bias-output signal line 132; and the second DC/RF isolation insulator 150 connects the second bias armature 142 with the second RF armature 144. A second contact 148 is electrically connected with the RF-input transmission line 106. In this way, one could use a common bias input/output to simply duplicate the signal on the RF-output signal line 108 on the second RF-output signal line 146 when the common bias-inputs close both armatures simultaneously. Alternatively, one could use a separate bias-input signal line that shares a common ground with the first device 128 to independently control the two RF-output signals, which could, for example, be used as an input to an RF multiplexer. As can be appreciated by one of ordinary skill in the art, the sharing of either the bias-input signal lines or the bias output signal lines, or sharing both the bias-input signal lines and the bias output signal lines to multiplex or duplicate a signal can easily be generalized and applied to the array of devices described above.

As can be appreciated by one of ordinary skill in the art, the invention described above can be formed such that the two devices have an arbitrary orientation with respect to one another. However, for purposes of illustration, FIG. 1 shows the first device 128 and the second device 130 in a substantially parallel geometry. The concept of being in a parallel geometry is made more concrete by identifying two parallel axes: the first axis 140 runs the length of the first bias armature 104, and the second axis 138 runs the length of the second bias armature 142. The first axis 140 and the second axis 138 are substantially parallel, which is what is meant by the first device 128 and the second device 130 being substantially parallel.

What is claimed is:

1. A micro-electro-mechanical system (MEMS) switch, comprising:

a radio-frequency (RF)-input transmission line formed on a substrate;

an RF-output transmission line formed on the substrate;

an RF armature connected by an RF anchor with the substrate, the RF armature being electrically connected with the RF-output transmission line;

a contact electrically connected with the RF-input transmission line and formed such that it is proximate the RF armature, the contact and the RF armature being formed such that when the MEMS switch is in an open position, a gap exists between the RF armature and the contact;

a bias-input signal line formed on the substrate;

a bias-output signal line formed on the substrate;

a bias armature connected by a bias anchor to the substrate, the bias armature being electrically connected with the bias-input signal line and being formed such that when the MEMS switch is in an open position, a gap exists between the bias armature and the bias-output signal line; and a direct current (DC)/RF isolation insulator connecting the bias armature with the RF armature, whereby when an electrical charge is introduced to the bias-input signal line, the bias armature is forced toward the bias-output signal line, thereby forcing the RF armature to connect with the contact and form an electrical circuit between the RF-input transmission line and the RF-output transmission line.

2. A MEMS switch as set forth in claim 1, further comprising an insulator layer formed on the bias armature such that it is positioned between the bias armature and the bias-output signal line, such that when the bias armature is forced toward the bias-output signal line, the insulator layer prevents an electrical connection therebetween.

3. A MEMS switch as set forth in claim 1, wherein the bias armature has a length with an axis running along its length, and wherein the RF armature has a length with an axis running along its length, wherein the bias armature is formed such that the axis of the bias armature makes an arbitrary angle to the axis of the RF armature.

4. A MEMS switch as set forth in claim 1, wherein the bias armature is formed such that it is substantially parallel to the RF armature.

5. A MEMS switch as set forth in claim 1, wherein the bias armature is formed such that it is substantially parallel to the RF armature, and the DC/RF isolation insulator is formed such that it is substantially perpendicular to both the bias armature and the RF armature.

6. A MEMS switch as set forth in claim 1, wherein the bias armature is formed such that it is substantially perpendicular to the RF armature.

7. A MEMS switch as set forth in claim 1, further comprising:

a second RF-output transmission line formed on the substrate;

a second RF armature connected by a second RF anchor with the substrate, the second RF armature being electrically connected with the second RF-output transmission line;

a second contact electrically connected with the second RF-input transmission line and formed such that it is proximate the second RF armature, the second contact and the second RF armature being formed such that when the MEMS switch is in an open position, a gap exists between the second RF armature and the second contact;

a second bias-input signal line formed on the substrate;

a second bias-output signal line formed on the substrate;

a second bias armature connected by a second bias anchor to the substrate, the second bias armature being electrically connected with the second bias-input signal line and being formed such that when the MEMS switch is in an open position, a gap exists between the second bias armature and the second bias-output signal line; and a second DC/RF isolation insulator connecting the second bias armature with the second RF armature, whereby when an electrical charge is introduced to the second bias-input signal line, the second bias armature is forced toward the second bias-output signal line, thereby forcing the second RF armature to connect with the second contact and form an electrical circuit between the RF-input transmission line and the second RF-output transmission line.

8. A MEMS switch as set forth in claim 7, where the bias armature has a long axis and the second bias armature has a long axis, and where the bias armature and the second bias armature are substantially parallel.

9. A MEMS switch as set forth in claim 7, wherein the signal lines are electrically connected in a combination selected from a group consisting of the bias-input signal line being electrically connected with the second bias-input signal line and the bias-output signal line being electrically connected with the second bias-output signal line, thereby allowing independent control of the RF-output signal line and the second RF-output signal line.

10. A MEMS switch as set forth in claim 7, wherein the bias-input signal line is electrically connected with the second bias-input signal line, and wherein the bias-output signal line is electrically connected with the second bias-output signal line, thereby forcing the RF-output signal line and the second RF-output signal line to produce substantially identical, substantially simultaneous signals.

11. A MEMS switch as set forth in claim 1, wherein the bias armature has a long axis, the RF armature has a long axis, and the bias armature is formed such that the long axis of the bias armature makes an arbitrary angle to the long axis of the RF armature.

12. An array of MEMS switches, where each switch is as set forth in claim 1, wherein each switch is formed on the substrate and is electrically connected with at least one other switch to form the array.

13. A method of forming a micro-electro-mechanical system (MEMS) switch, comprising acts of:

forming a radio-frequency (RF)-input transmission line formed on a substrate;

forming an RF-output transmission line formed on the substrate;

connecting an RF armature by an RF anchor with the substrate, the RF armature being electrically connected with the RF-output transmission line;

connecting a contact with the RF-input transmission line, the contact formed such that it is proximate the RF armature, the contact and the RF armature further being formed such that when the MEMS switch is in an open position, a gap exists between the RF armature and the contact;

forming a bias-input signal line on the substrate;

forming a bias-output signal line on the substrate;

connecting a bias armature by a bias anchor with the substrate, the bias armature being electrically connected with the bias-input signal line and being formed such that when the MEMS switch is in an open position, a gap exists between the bias armature and the bias-output signal line; and connecting a direct-current (DC)/RF isolation insulator between the bias armature and the RF armature, whereby when an electrical charge is introduced to the bias-input signal line, the bias armature is forced toward the bias-output signal line, thereby forcing the RF armature to connect with the contact and form an electrical circuit between the RF-input transmission line and the RF-output transmission line.

14. A method as set forth in claim 13, further comprising an act of forming an insulator layer on the bias armature such that it is positioned between the bias armature and the bias-output signal line, such that when the bias armature is forced toward the bias-output signal line, the insulator layer prevents an electrical connection therebetween.

15. A method as set forth in claim 13, wherein in the act of forming the bias armature, the bias armature is formed such that it has a length with an axis running along its length, and wherein in the act of forming the RF armature, the RF armature is formed such that it has a length with an axis running along its length, and wherein the bias armature is formed such that the axis of the bias armature makes an arbitrary angle to the axis of the RF armature.

16. A method as set forth in claim 13, wherein in the act of forming the bias armature, the bias armature is formed such that it is substantially parallel to the RF armature.

17. A method as set forth in claim 13, wherein in the act of forming the bias armature, the bias armature is formed such that it is substantially parallel to the RF armature, and wherein in the act of forming the DC/RF isolation insulator, the DC/RF isolation insulator is formed such that it is substantially perpendicular to both the bias armature and the RF armature.

18. A method as set forth in claim 13, wherein in the act of forming the bias armature, the bias armature is formed such that it is substantially perpendicular to the RF armature.

19. A method as set forth in claim 13, further comprising acts of:

forming a second RF-output transmission line formed on the substrate;

forming a second RF armature;

connecting a second RF armature by an RF anchor with the substrate, the second RF armature being formed such that it is electrically connected with the second RF-output transmission line;

connecting a second contact with the second RF-input transmission line, the second contact formed such that it is proximate the second RF armature, the second contact and the second RF armature further being formed such that when the MEMS switch is in an open position, a gap exists between the second RF armature and the second contact;

forming a second bias-input signal line on the substrate;

forming a second bias-output signal line on the substrate;

connecting a second bias armature by a second bias anchor to the substrate, the second bias armature being electrically connected with the second bias-input signal line and being formed such that when the MEMS switch is in an open position, a gap exists between the second bias armature and the second bias-output signal line; and connecting a second DC/RF isolation insulator between the second bias armature and, whereby when an electrical charge is introduced to the second bias-input signal line, the second bias armature is forced toward the second bias-output signal line, thereby forcing the second RF armature to connect with the second contact and form an electrical circuit between the RF-input transmission line and the second RF-output transmission line.

20. A method as set forth in claim 19, wherein in the act of forming the bias armature, the bias armature is formed such that it has a long axis, and wherein in the act of forming the second bias armature, the second bias armature is formed such that it has a long axis, and wherein the bias armature and the second bias armature are formed such that they are substantially parallel.

21. A method as set forth in claim 19, wherein the signal lines are connected in a combination selected from a group consisting of the bias-input signal line being electrically connected with the second bias-input signal line and the bias-output signal line being electrically connected with the second bias-output signal line, thereby allowing independent control of the RF-output signal line and the second RF-output signal line.

22. A method as set forth in claim 19, wherein in the act of forming the bias-input signal line, the bias input signal line is formed such that it is electrically connected with the second bias-input signal line, and wherein the bias-output signal line is electrically connected with the second bias-output signal line, thereby forcing the RF-output signal line and the second RF-output signal line to produce substantially identical, substantially simultaneous signals.

23. A method as set forth in claim 13, wherein in the act of forming the bias armature, the bias armature is formed such that it has a long axis, and wherein in the act of forming the RF armature, the RF armature has a long axis, and forming the bias armature such that the long axis of the bias armature makes an arbitrary angle to the long axis of the RF armature.

24. A method of forming an array of MEMS switches, where each switch is formed as set forth in claim 13, further comprising acts of:

forming each switch on the substrate; and electrically connecting each switch with at least one other switch.

* * * * *